US007677623B2

(12) United States Patent
Bath et al.

(10) Patent No.: US 7,677,623 B2
(45) Date of Patent: Mar. 16, 2010

(54) ACTIVE RIGGING DEVICE

(75) Inventors: William R. Bath, Cypress, TX (US); Frank Sayle, Sealy, TX (US)

(73) Assignee: Sonsub Inc., Houston, TX (US)

( * ) Notice: Subject to any disclaimer, the term of this patent is extended or adjusted under 35 U.S.C. 154(b) by 693 days.

(21) Appl. No.: 10/434,770

(22) Filed: May 9, 2003

(65) Prior Publication Data

US 2004/0164572 A1 Aug. 26, 2004

Related U.S. Application Data

(60) Provisional application No. 60/449,672, filed on Feb. 24, 2003.

(51) Int. Cl.
*B66C 1/10* (2006.01)

(52) U.S. Cl. ..... 294/81.5; 294/81.1

(58) Field of Classification Search ..... 294/81.5, 294/81.1, 81.2, 82.11; 166/344; 405/168.1, 405/168.2

See application file for complete search history.

(56) References Cited

U.S. PATENT DOCUMENTS

| | | | | | |
|---|---|---|---|---|---|
| 3,532,162 | A | * | 10/1970 | Fischer | 166/360 |
| 3,983,708 | A | * | 10/1976 | Houot | 405/168.1 |
| 4,541,754 | A | * | 9/1985 | Castel et al. | 405/168.1 |
| 4,542,928 | A | * | 9/1985 | Fowler, Jr. | 294/81.1 |
| 4,702,320 | A | * | 10/1987 | Gano et al. | 166/343 |
| 4,795,405 | A | * | 1/1989 | Davis | 472/78 |
| 6,405,802 | B1 | | 6/2002 | Williams | |

FOREIGN PATENT DOCUMENTS

| | | | | |
|---|---|---|---|---|
| JP | 6-144774 | * | 5/1994 | 294/81.1 |

* cited by examiner

*Primary Examiner*—Paul T Chin
(74) *Attorney, Agent, or Firm*—Howrey LLP

(57) ABSTRACT

An active rigging system, using multiple lines to support a load, places a constant tension on at least one of the lines. The constant tension allows a resistance to slack in the line, which in turn allows the line to maintain support of the lines' respective share of the load. This configuration allows a reduction of stress in the load and an enablement of support of loads having an unequal weight distribution. Additionally, the invention includes a method for relieving stress from a load, supported by multiple lines generally susceptible to slack. The method includes placing a constant tension on at least one of the lines to allow that line to resist slack. The resistance to slack involves utilizing a tension force and an adjustment of the line via a pulley.

46 Claims, 4 Drawing Sheets

FIG. 2
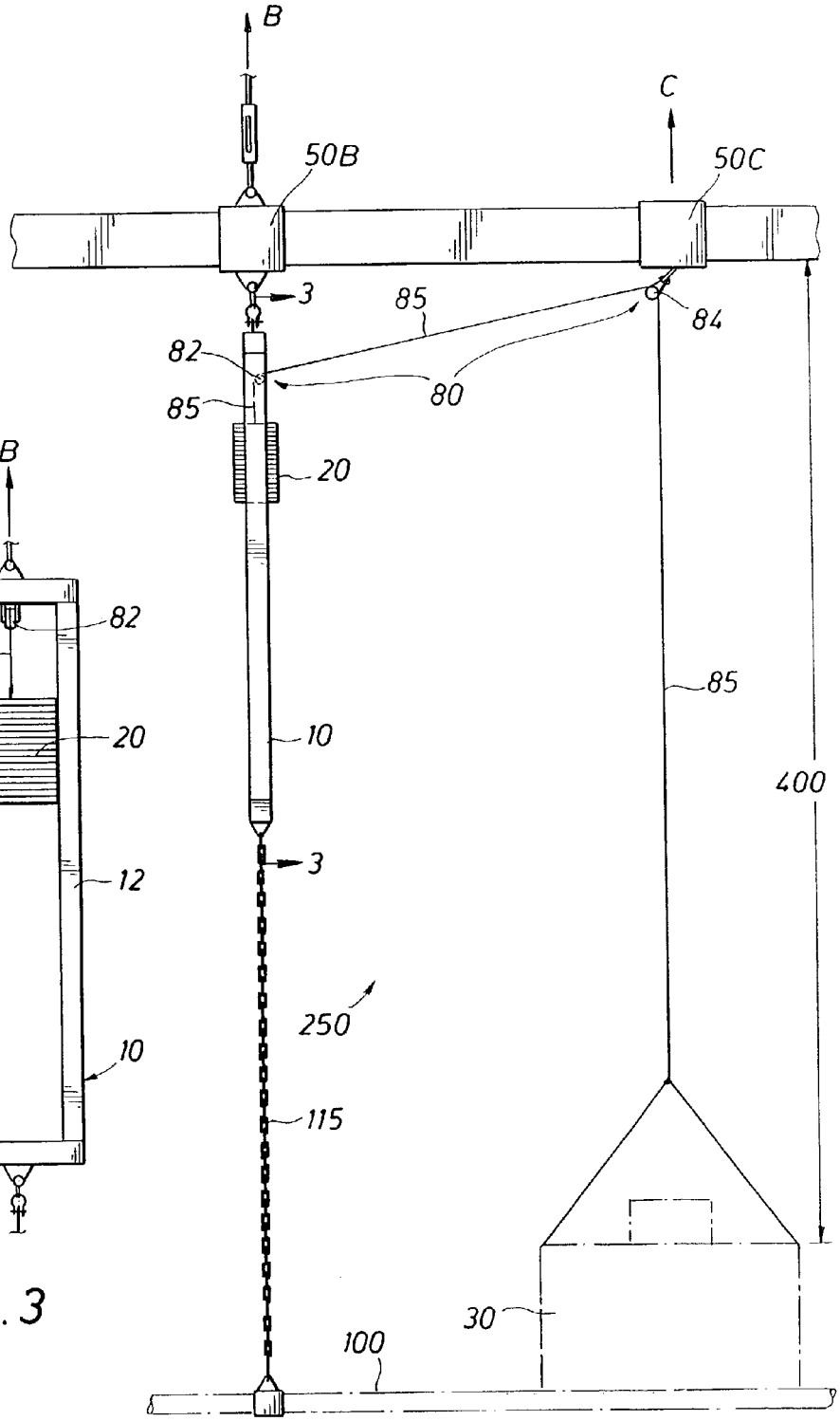
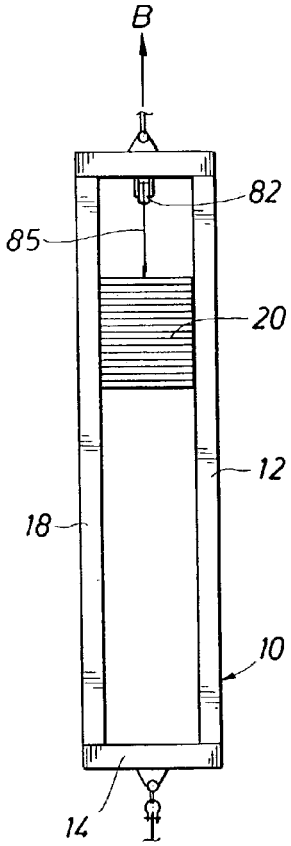
FIG. 3

ACTIVE RIGGING DEVICE

CROSS-REFERENCE TO RELATED APPLICATIONS

The present application claims priority from U.S. Provisional Application Ser. No. 60/449,672, filed Feb. 24, 2003, which is incorporated herein in its entirety by reference.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to devices arranged and designed to support loads and more specifically to devices which facilitate the installation of subsea equipment.

2. Description of the Related Art

In the offshore oil and gas production industry, flowlines are commonly used to facilitate fluid communication from one piece of subsea equipment to another. Several different devices are known in the art, which can enable such connection; however, a commonly used subsea device is what is known as a jumper system. In a typical jumper system, two end connectors, having a flowline portion connected therebetween, are each fluidly coupled with a piece of subsea equipment. These pieces of subsea equipment include, but are not limited to Christmas trees, manifolds, processing equipment, and other flowline ends. As an example, the jumper system can be used to fluidly couple a flowline with a wellhead. The first jumper end connector is fluidly coupled to the end of the flowline and the second end connector can be fluidly coupled with the wellhead.

The installation of a subsea jumper system initially involves the vertical lowering of the jumper system's associated parts—namely, the jumper end connectors, flowline portion and other equipment, which may be utilized—to the seabed. The fluid coupling of the end connectors will depend to a large degree on the type of end connectors involved and the pieces of subsea equipment being fluidly coupled. Some end connectors are vertically stabbed or landed on the device, fluidly mating therewith, while others can be horizontally stabbed or connected. Some end connectors require help from divers, while others can be installed utilizing a remotely operated vehicle (ROV).

One recognized device used in the vertical lowering of a jumper system to the seabed is a spreader bar. For example, in U.S. Pat. No. 6,405,802, issued to Williams, a subsea flowline jumper handling apparatus is disclosed having cables or lines suspended from a spreader bar to support the flowline jumper. When loads such as this are vertically lowered to the seabed, a problem exists if and when a spreader bar line goes slack. If one or more of the support lines go slack, an unequal support of the load can occur, thereby causing excessive stress in the load. Such a problem is even further exacerbated if the load has an unequal weight distribution.

SUMMARY OF THE INVENTION

The present invention is an active rigging system which is arranged and designed to support a load. The active rigging system in one embodiment includes a spreader bar and a plurality of lines utilized to support the load. As the lines can generally be susceptible to slack, at least one of the lines resists going slack and is always maintained in tension while supporting the load. This resistance to slack allows the constant tension line to constantly maintain support of the portion of the load supported by the constant tension line. In turn, the maintenance of support allows a reduced stress on the load and an enablement to support loads having unequal weight distributions.

A tensioning force system helps enable the maintenance of constant tension and support. In one configuration, the tensioning force system includes a pulley which allows adjustment in a length of at least one of the plurality of lines. In another configuration, the tensioning force system includes a tensioning force, which is independent of the component force and acts upon at least one of the plurality of lines. In yet another configuration, a pulley and a tensioning force, independent of the component force, are utilized to adjust and act upon at least one of the plurality of lines.

The invention also includes a method for removing stress from a portion of a load supported by a plurality of lines susceptible to slack. In one embodiment of this method, the load is generally suspended from the plurality of lines with at least one of the plurality of lines maintaining a constant tension to resist slack. Applying a tensioning force and adjusting the above-referenced line enables this resistance to slack.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 2 shows in a more detailed view a configuration of the tensioning force system of FIG. 1, supporting a specific portion of the load;

FIG. 3 is a view taken along line 3-3 of FIG. 2, showing the details of the frame and counterweight utilized to provide the force in the embodiment of tensioning force system of FIG. 1 and 2;

DETAILED DESCRIPTION OF THE INVENTION

Figure 1:
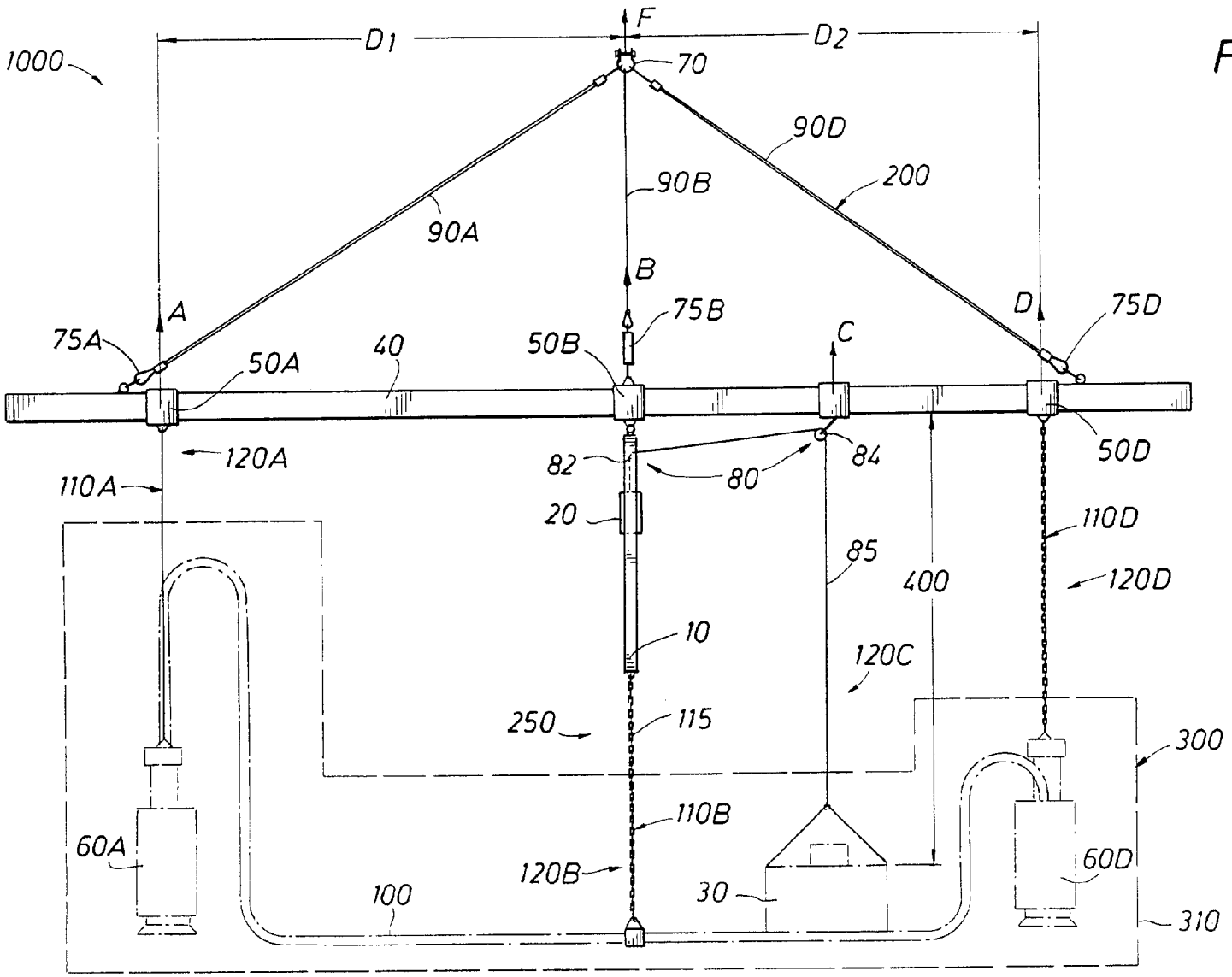
FIG. 1 is an elevational view of an embodiment of the active rigging system supporting a load.

FIG. 1 is an elevational view of an embodiment of the active rigging system 1000 of the present invention. In this embodiment, a single force, generally indicated by arrow F, supports a load 300 via the use of a force distributor 200. The force distributor 200, as shown in this embodiment includes shackles 70, 75A, 75B, and 75D, slings 90A, 90B, and 90D, and a spreader bar 40. The force distributor 200 has distributed force F into four component forces, indicated by arrows A, B, C, and D. The arrangement and design of force distributor 200 can be adjusted, depending on the desired distribution of the single force F and load 300 being carried. As a simple illustration of this adjustment, if the single force F is broken into two component forces with each component force being equal in magnitude, the forces can be applied at equidistances on spreader bar 40, utilizing slings 90A and 90D of equal length. If one of the equal magnitude component forces is changed, the distance from the single force F of the smaller force will increase, along with the length of the associated sling 90 to enable a balance in the spreader bar 40 via the equalization of forces. Such equalization of forces should become apparent to one of ordinary skill in the art of structural design.

As indicated above, the load equalization of the force distributor 200 in the embodiment as shown in FIG. 1 provides component forces A, B, C, and D along the length of the spreader bar 40 to support the load 300. In the illustrated embodiment, the enablement of this equalization is via the use of three slings 90A, 90B, and 90D, which are connected at an upper end to a shackle 70 and at lower ends to shackles 75A, 75B, and 75D, respectively. These three slings 90A, 90B, and 90D generally provide the upward support to the spreader bar 40. The sling 90B, preferably directed vertically downwards from force F, is connected to the shackle 75B. Preferably, the shackle 75B is at the center of equalization of a magnitude force, which would be needed to support the component forces A, B, C, and D on the spreader bar 40. As this center of equalization can shift depending on forces A, B, C, and D and their location on spreader bar 40, the shackle 75B is connected to the clamp 50B, which is arranged and designed to move along the length of the spreader bar 40—changing the center of equalization. The sling 90A connects to the shackle 75A at a distance D1 from the shackle 75B and the clamp 50B, while the sling 90D connects to the shackle 75D at a distance D2 from the shackle 75B and the clamp 50B. In this embodiment, the clamp 50B has been shifted slightly to the right of center on the spreader bar 40, making the distance D1 slightly larger than the distance D1. Such a shift indicates that more leverage is needed on the left side of the spreader bar 40.

The spreader bar 40 can be any one of the type of spreader bars which are typically used in spreader bar applications. In this embodiment, the spreader bar 40 is preferably made of steel pipe and has clamps 50A, 50B, 50C, and 50D, which enable the selection of location of the component forces A, B, C, and D. As indicated above, the clamp 50B allows adjustment for the center of equalization of the force distributor 200. To the extent foreseeable, other configurations should become apparent to one of ordinary skill in the art. While a steel pipe is shown in this embodiment for the spreader bar 40, it is to be understood that other embodiments can utilize other spreader bar configurations, as for example, steel beams, adjustable length spreader bars, and three dimensional cages.

The load 300 being supported in the illustrated embodiment is a jumper system 310, including end connectors 60A and 60D, a flowline portion 100, and a flowmeter 30. As indicated in the Background, the jumper system 310 can be utilized in the facilitation of fluid communication between various items of subsea equipment. In the lowering of this load 300, the end connectors 60A and 60D are each vertically landed on subsea equipment while the flowline portion 100 is layed on the seabed. The flowmeter 30, as its name implies, helps measure the flow through the flowline portion 100. The flowline portion 100 as should become apparent to those skilled in the art can be made of either a flexible or rigid material. The jumper system 310, disclosed in the embodiment shown in FIG. 1, has an unequal weight distribution with the three heaviest parts of the jumper system 310 being the end connectors 60A and 60D, and the flowmeter 30.

Generally supporting the load 300 in FIG. 1 are four lines 120A, 120B, 120C, and 120D. In this embodiment, line 120A is a suspension line 110A, line 120B is a modified suspension line 1101B, line 120C is a constant tension line 85, and line 120D is a suspension line 110D. In the absence of the flowmeter 30, suspension lines 110A and 110D could typically suspend the load 300. The suspension line 110A could support the end connector 60A and suspension line 110D could support the end connector 60D, with the flowline portion 100 extending therebetween. If the flowline portion 100 needed additional support, a third suspension line (not shown) could be utilized at a central location between the end connectors 60A and 60D.

With the installment of the flowmeter 30 to the jumper system 310 as shown in FIG. 1, the dynamics of the installation of the jumper system 310 have changed. The flowline portion 100 is not typically designed to support the weight of the flowmeter 30. As such, the downward force exerted by the flowmeter 30 on the flowline portion 100 could impart an excessive stress on the jumper system 310, causing the flowline portion 100 to break or buckle. Such a force could be caused, for example, by one or more of the lines going slack, forcing the flowline portion 100 to support the flowmeter 30. As an illustrative example only, if the lines 120B and 120C went slack, the flowline portion 100, being supported by only end connector 60D (and corresponding suspension line 110D) and end connector 60A (and corresponding suspension line 110A), would experience stress and strain resulting from the flowmeter 30 acting thereon. While slack in suspension lines 120A, 120B, 120C, and 120D is undesired, the slack can occur for a variety of reasons. For example, in a subsea environment, current forces can vary at different locations on the load 300; and in an above-sea environment, wind forces can vary at different locations on the load 300. Additionally, horizontal movement can cause the load 300 to sway due to water or air resistance.

The active rigging system 1000 facilitates the relief of some of these undesired stresses by maintaining constant tension on at least one of the lines 120A, 120B, 120C, or 120D. The line 120A, 120B, 120C, or 120D, having constant tension in the illustrated embodiment is line 120C, indicated above as constant tension line 85. The constant tension on constant tension line 85 helps to relieve at least a portion of the load 300, namely the flowmeter 30 in this embodiment, by allowing the constant tension line 85 to maintain support of the flowmeter 30. Such maintenance of support, in turn, relieves stress in the load 300 and enables the load 300 to have an unequal weight distribution. As shown in the embodiment, the constant tension is accomplished via a tensioning force system 250, which includes the tensioning line 85, a pulley system 80, a counterweight 20, and a guide frame 10. The tension in lines 120A, 120B, and 120D are all relative. That is, the tension on each of these lines 120A, 120B, and 120D depends on a tensile force constantly being applied on each end. The removal of tensile force in one of these lines 120A, 120B, or 120D can cause the respective line to go slack. As an example, the end connector 60A has the force of gravity acting down upon it—the force of gravity being resisted by the suspension line 110A connected to the spreader bar 40, which supports the suspension line 110A with a component force A, as indicated above, at that specific location. When the entire load 300 or a portion of the load 300 is acted upon by an environmental force (e.g., an underwater current pushing up on the end connector 60A) and relieves the tensile force on the suspension line 110A, the suspension line 110A goes slack. In a similar manner, each of these suspension lines 120A, 120B, and 120D can go slack upon one of the above mentioned environmental forces acting on the load 300.

To counteract this relative tension effect, the tensioning force system 250 applies a constant tension on the tension line 85. The constant tension, in this embodiment, is enabled via a tensioning force acting upon the tension line 85 and an adjustment of a length 400 for the line 85. The tensioning force, as will be described below, acts independent of the force F and component forces A, B, C, and D. The length 400, as shown in this embodiment is generally the distance between the spreader bar 40 and the flowmeter 30. This length 400 would generally be the length of the line 120C if it were directly connected to the spreader bar 40.

FIGS. 2 and 3 show in a more detailed view the tensioning force system 250. As indicated above, the tensioning force system 250 includes a pulley system 80, the tension line 85, a guide frame 10, and a counterweight 20. The concept behind this tensioning force system 250 is to provide a constant tension upon the tension line 85 that actively helps prevent slack from occurring in a specific line (e.g., tension line 85), ultimately facilitating the maintenance of support for a specific portion of the load 300 (e.g., flowmeter 30, shown in this embodiment). The enablement of this slack removing, constant tension force in this embodiment is via a tensioning force, namely the counterweight 20 that moves relative to the guide frame 10, adjusting the length 400. In this configuration, the tension line 85 is slung over pulleys 82 and 84 such that when the tension line 85 tries to go slack, the counterweight 20 will adjust (e.g, moving down the guide frame 10 and adjusting the length 400), preventing slack and providing constant tension and support for the flowmeter 30. Such a constant tension force, as indicated above, translates into a removal of excessive stress due to gravitational forces of the flowmeter 30 upon the flowline portion 100.

With respect to the aforementioned component forces B and C, the component force B vertically supports the guide frame 10, pulley 82, and flowline portion 100 via a modified suspension line 110B. The modified suspension line includes the guide frame 10 and a chain 115 or cable. In this regard, the guide frame 10 has been arranged and designed to translate this support from component force B through the frame walls 18 and 12, and through the chain 115. The component force C vertically supports the counterweight 20, flowmeter 30, as well as the weight of the pulley 84.

The guide frame 10, as seen in FIG. 3, generally shows the placement of the counterweight 20 within the guide frame 10, which moves, preferably slidingly, up and down with respect to the guide frame 10. The sliding movement is similar to a machined weight system seen in gyms, but on a larger scale. At the bottom of the guide frame 10 is a frame end stop 14 which prevents the weight from further downward movement. The frame end stop 14 allows the tension line 85 to go slack when, for example, the load 300 has been landed.

The tensioning force (e.g, the counterweight 20) is preferably in proportion to the portion of the load (e.g., flowmeter 30) in which the constant tension force is arranged and designed to support. For example, in the embodiment shown in FIGS. 1-3, the force of constant tension caused by the counterweight 20 is a percentage, up to 100%, of the weight of the flowmeter 30. The tensioning force in other embodiments can be greater than the weight for which it is designed; however, if the force is too much a reverse negative stress could be created. For example, the constant tension of the tension line 85 in this embodiment is designed to remove the downward force of the flowmeter 30 on the flowline portion 100. If too large of a force is caused by counterweight 20, an unwanted upward force could be created on the flowline portion 100.

While the tensioning force described with reference to the embodiments of FIGS. 1-3 has generally been described as a counterweight 20, other tensioning forces may be utilized to the extent foreseeable by those of ordinary skill in the art. For example, the tensioning force could be caused by a spring, a buoy, dynamic positioning devices, and the like.

In the design of the tensioning force system 250, the constant tension force is preferably arranged and designed such that when negative environmental forces act upon the load 300 and attempt to interrupt the support of the lines 120A, 120B, 120C and 120D, by effecting the tensile forces of the lines, they are minimized, if not eliminated, from effecting the constant tension force and its ability to create a constant tension on the tension line 85.

Figure 4:
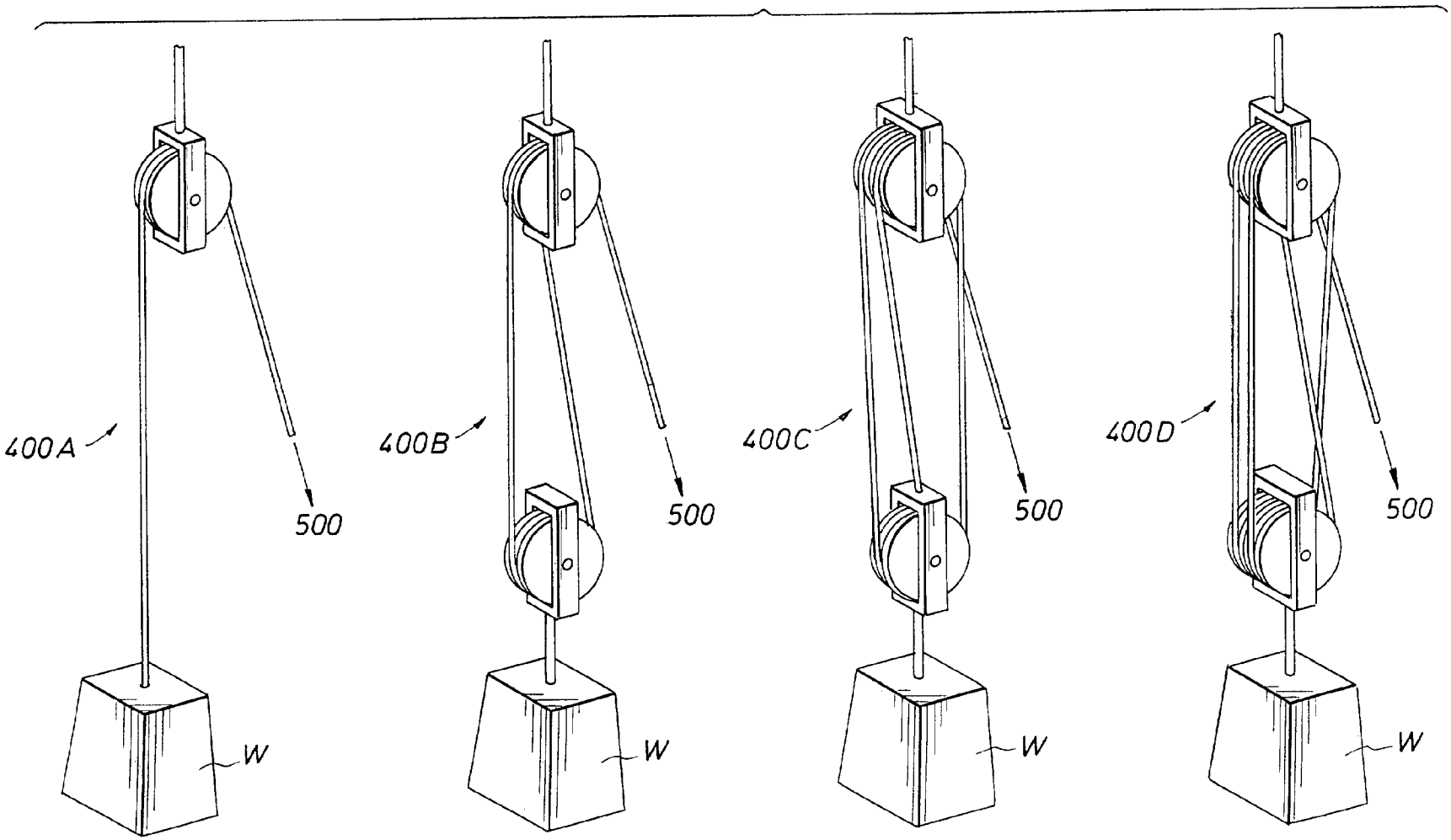
FIG. 4 shows a first set of configurations of pulleys, utilizing a downward force for the tensioning force system.

FIG. 4 is illustrative of a first set of pulley configurations which, in general, can be utilized in the pulley system 80 of the tensioning force system 250 of FIGS. 1-3. These pulley configurations 400A, 400B, 400C, and 400D, should become apparent to one of ordinary skill in the art. For ease of illustration, pulley configurations 400A, 400B, 400C, and 400D have been shown in the abstract. The common feature for the designs of the illustration of FIG. 4 is that all the pulley configurations 400A, 400B, 400C, and 400D take advantage of a downward tensioning force 500—for example, gravity. In that regard, each pulley configuration 400A, 400B, 400C, and 400D has a different mechanical advantage. Pulley configuration 400A is a simple pulley with a mechanical advantage of 1:1; pulley configuration 400B has a mechanical advantage of 1:2, using two pulleys; pulley configuration 400C has a mechanical advantage of 1:3, using three pulleys; and pulley configuration 400D has a mechanical advantage of 1:4, using four pulleys. Other pulley configurations can be utilized to the extent foreseeable by one or ordinary skill in the art.

Figure 5:
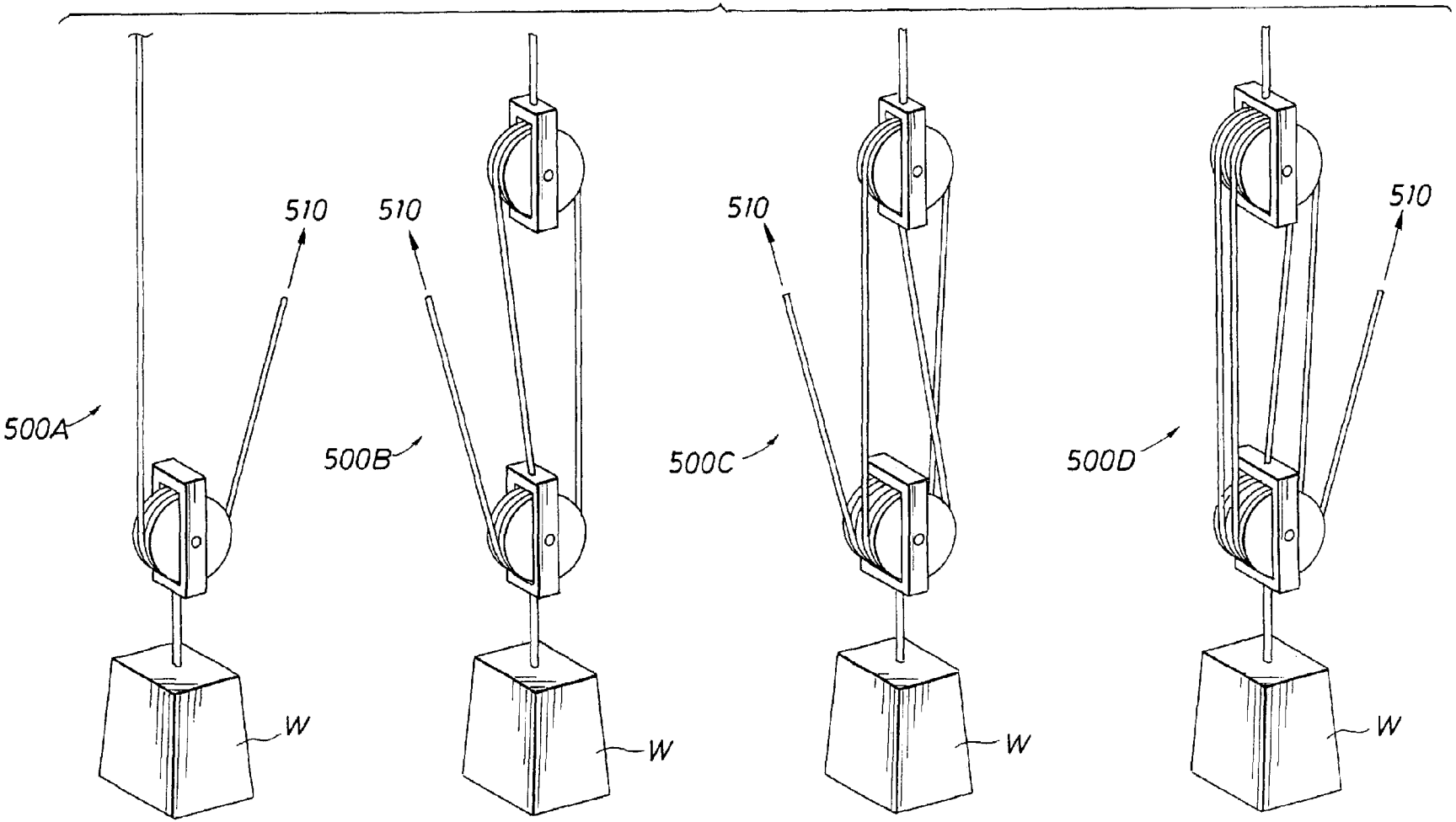
FIG. 5 shows a second set of configurations of pulleys, utilizing an upward force for the tensioning force system.

FIG. 5 is illustrative of a second set of pulley configurations which, in general, can be utilized in the pulley system 80 of the tensioning force system 250 of FIGS. 1-3. These pulley configurations 500A, 500B, 500C, and 500D, in a manner similar to that of FIG. 4, should also become apparent to one of ordinary skill in the art. The common feature for the designs of the illustration of FIG. 5 is that all the pulley configurations 500A, 500B, 500C, and 500D take advantage of an upward force 510. Other pulley configurations can be utilized to the extent foreseeable by one of ordinary skill in the art. Upward force 510 can take on many different forms, depending on the design and use of the active rigging system 1000 and the pulley configurations 500A, 500B, 500C, and 500D. As one example, intended for illustrative purpose only, a buoyant force could be utilized in a subsea environment. This buoyant force could be something as simple as buoy, having a buoyant force (calculated using Archimedes' principal). The adjustment of this buoyant force can be via ballasting, utilizing techniques known in the art.

Turning now back to FIGS. 1 and 2, the active rigging system 1000 can be viewed as a system which protects against excessive stress in portions of a load 300 by compensating for situations in which deviation occurs from a perfect hypothetical balanced force design. In this perfect hypothetical balanced force design, two main anticipated forces are taken into consideration. The first force is the force of gravity acting upon both the active rigging system 1000 and the load 300. The second force is the generally upward force supporting the active rigging system 1000 and load 300. Absent any other forces, this hypothetical balanced force design in a static state provides an equalization of forces; and in such hypothetical static state, each of the lines 120A, 120B, 120C, and 120D in FIGS. 1 and 2 would be in constant tension. However, in a typical setting the load 300 is not designed to be static, but rather to be moved from one location to another. For example, once again looking at FIGS. 1 and 2, the load 300 generally including subsea equipment (e.g., jumper system 310) is being vertically lowered to the seafloor. In this movement, environmental forces begin to enter into the equation, deviating the perfect hypothetical balanced design. Such environmental forces can include, among other things, air and water resistance (e.g., as a load 300 is moved vertically or horizontally), currents, waves, and storms. Any one of these environmental forces could result in one or more of the lines going slack and temporarily not supporting any portion of the load 300, thus interrupting the support a specific line was designed to support. With unequal support on the load 300 (e.g., some of the lines being slack while other lines are in tension), undesired stresses can be imparted on the load 300. A further exacerbation of these undesired stresses can occur in loads having unequal weight distributions. To this end, and as a partial solution to this problem, the active rigging system 1000 introduces an extra tensioning force, independent of the above-mentioned generally upward force.

As an example of alleviation of these undesired stresses, the embodiment in FIGS. 1-3 shows how an active rigging system 1000 can alleviate the stress from a load 300. Specifically, as discussed above, this embodiment includes an unequally distributed load 300. The heaviest portions of the load 300 are the flowmeter 30 and two end connectors 60A and 60D. In this embodiment, the flowline portion 100 is not designed to solely support the weight of the flowmeter 30. One of the above-mentioned environmental factors (e.g., including, but not limited to, water resistance from moving the load 300 horizontally or vertically into place, wind currents, and tidal currents) can cause a slack in those lines, interrupting the support derived from those lines—even for a short period of time. In an embodiment such as this, the support is not regained until tension resumes in those lines. However, by this time the load 300 may have already been subjected to an undesired stress. As such, the arrangement and design of the active rigging system 1000 allows the removal of a substantial portion of the weight of the flowmeter 30 from being imparted on the flowline portion 100—even for short periods of time.

The foregoing disclosure and description of the invention are illustrative and explanatory thereof, and various changes in the details of the illustrated apparatus and construction and method of operation may be made to the extent foreseeable without departing from the spirit of the invention.

We claim:

1. An active rigging system, arranged and designed for supporting a load, comprising:

a plurality of lines, arranged and designed to support the load, and a tensioning force system that maintains constant tension in at least one of said plurality of lines when the plurality of lines is supporting the load, wherein said tensioning force system comprises a tensioning line, a tensioning force, and a guide frame, wherein the guide frame comprises a counterweight that is movable within frame walls of the guide frame while providing tension on at least the tensioning line, wherein at least one of said plurality of lines is attached to the guide frame.

2. The active rigging system of claim 1, wherein said maintenance of constant tension in at least one of said plurality of lines reduces stress in the load.

3. The active rigging system of claim 1, wherein said maintenance of constant tension in at least one of said plurality of lines allows the maintenance of support in at least a portion of the load, even when slack is imparted on said plurality of lines.

4. The active rigging system of claim 3, wherein said maintenance of support in at least a portion of the load reduces stress in the load.

5. The active rigging system of claim 3, wherein said maintenance of support in at least a portion of the load allows a load having an unequal distribution to be supported.

6. The active rigging system of claim 1, wherein said maintenance of constant tension reduces stress in the load.

7. The active rigging system of claim 1, wherein each of said plurality of lines are susceptible to slack, and said tensioning force system maintains tension on said line via enabling a resistance to said slack in at least one of said plurality of lines.

8. The active rigging system of claim 7, wherein the enabling of resistance to said slack is at least partially accomplished through an adjustment of a length of at least one of said plurality of lines.

9. The active rigging system of claim 1, wherein said tensioning force is at least partially caused by a counterweight.

10. The active rigging system of claim 1, wherein said tensioning force is at least partially caused by a buoy.

11. The active rigging system of claim 1, wherein said tensioning force system includes a pulley system.

12. The active rigging system of claim 1, wherein the load is generally subjected to a force of gravity, and wherein said plurality of lines utilize a plurality of component forces to support the load further comprising:

a first end and a second on each of said plurality of lines wherein forces are applied on said first and second end of each of said plurality of lines causing at least a relative tension on each of said plurality of lines the force applied to said second end of each of said plurality of lines is said force of gravity acting on the load, and the force applied to said first end of at least one of said plurality of lines is a tensioning force, which is independent of said plurality of component forces.

13. The active rigging system of claim 1, wherein the load has an unequal distribution to be supported.

14. The active rigging system of claim 1, wherein said tensioning force system includes a pulley system that connects said tensioning line with said tensioning force on one end of said tensioning line and a portion of the load on the other end of said tensioning line.

15. The active rigging system of claim 1, wherein said load is at least partially supported by said guide frame and a suspension line.

16. An active rigging system, arranged and designed for supporting a load, wherein the load is generally subjected to a force of gravity, and wherein said active rigging system utilizes a plurality of component forces to support the load comprising:

a plurality of lines, which utilize said plurality of component forces to support the load, a first end and a second end on each of said plurality of lines wherein forces are applied on said first and second end of each of said plurality of lines causing at least a relative tension on each of said plurality of lines, the force applied to said second end of each of said plurality of lines is said force of gravity acting on the load, and the force applied to said first end of at least one of said plurality of lines is a tensioning force, which is independent of said plurality of component forces, wherein said tensioning force is used with a guide frame and allows the load to be supported, wherein the guide frame comprises a counterweight that is movable within frame walls of the guide frame while providing tension on at least the tensioning line, wherein at least one of said plurality of lines is attached to the guide frame.

17. The active rigging system of claim 16, wherein said tensioning force reduces stress in the load.

18. The active rigging system of claim 16, wherein said tensioning force allows the maintenance of support in at least a portion of the load, even when slack is imparted on said plurality of lines.

19. The active rigging system of claim 18, wherein said maintenance of support in at least a portion of the load reduces stress in the load.

20. The active rigging system of claim 18, wherein said maintenance of support in at least a portion of the load allows a load having an unequal distribution to be supported.

21. The active rigging system of claim 16, further comprising a force distributor, arranged and design to divide said at least one lifting force into said plurality of component forces.

22. The active rigging system of claim 16, wherein said tensioning force is at least partially caused by a counterweight.

23. The active rigging system of claim 16, wherein said tensioning force is at least partially caused by a buoy.

24. The active rigging system of claim 16, wherein said wherein said tensioning force utilizes a pulley system.

25. The active rigging system of claim 16, wherein said tensioning force acts on at least one of said plurality of lines to maintain constant tension on at least one of said plurality of lines.

26. The active rigging system of claim 25, further including a tensioning force system, wherein each of said plurality of lines are susceptible to slack, and said tensioning force system maintains constant tension on said line via enabling a resistance to said slack in said at least one of said plurality of lines.

27. The active rigging system of claim 26, wherein said enabling of resistance to said slack is at least partially accomplished through an adjustment of a length of said at least one of said plurality of lines.

28. The active rigging system of claim 16, wherein the load has an unequal distribution to be supported.

29. An active rigging system, arranged and designed to support a load, wherein the load at times is acted upon by at least one environmental force, comprising:

a plurality of lines, wherein each of said plurality of lines support a portion of the load, said at least one environmental force upon acting on the load has the capacity to interrupt said support in each of said plurality of lines, at least one of said plurality of lines is arranged and designed to maintain support on said portion of the load supported by said at least one of said plurality of lines when said environmental force acts upon the load; and a tensioning force system, wherein said tensioning force system includes a tensioning line, a tensioning force, and a guide frame, wherein the guide frame comprises a counterweight that is movable within frame walls of the guide frame while providing tension on at least the tensioning line, wherein at least one of said plurality of lines is attached to the guide frame.

30. The active rigging system of claim 29, wherein said maintenance of support in said portion of the load reduces stress in the load.

31. The active rigging system of claim 29, wherein said maintenance of support in at least a portion of the load allows a load having an unequal distribution to be supported.

32. The active rigging system of claim 29, wherein at least one of said plurality of lines is further arranged and designed to maintain constant tension thereon.

33. The active rigging system of claim 32, wherein said capacity of said at least one environmental force to interrupt said support in each of said plurality of lines is caused by a susceptibility to slack in each of said plurality of lines, and said tensioning force system maintains tension on said line via enabling a resistance to said slack in at least one of said plurality of lines.

34. The active rigging system of claim 33, wherein said resistance to slack is accomplished through the adjustment of a length of at least one of said plurality of lines.

35. The active rigging system of claim 34, wherein said tensioning force system includes a tensioning force, acting on at least one of said plurality of lines to maintain constant tension on at least one of said plurality of lines.

36. The active rigging system of claim 35, wherein wherein said tensioning force is at least partially caused by a counterweight.

37. The active rigging system of claim 35, wherein said tensioning force is at least partially caused by a buoy.

38. The active rigging system of claim 35, said tensioning force system includes a pulley system.

39. The active rigging system of claim 29, wherein the load is generally subjected to a force of gravity, and wherein said plurality of lines utilize a plurality of component forces to support the load further comprising:

a first end and a second on each of said plurality of lines wherein forces are applied on said first and second end of each of said plurality of lines causing at least a relative tension on each of said plurality of lines, the force applied to said second end of each of said plurality of lines is said force of gravity acting on the load, and the force applied to said first end of at least one of said plurality of lines is said tensioning force, which is independent of said plurality of component forces.

40. An active rigging system, arranged and designed for supporting a load, comprising:

a plurality of lines, arranged and designed to support the load; and means for maintaining constant tension in one of said plurality of lines by a tensioning force system that includes a guide frame, wherein the guide frame comprises a counterweight that provides tension on at least one of the plurality of lines, wherein at least one of said plurality of lines is attached to the guide frame.

41. The active rigging system of claim 40, wherein the load has an unequal distribution to be supported.

42. An active rigging system, arranged and designed for supporting a load, comprising:

a force distributor, a plurality of lines, wherein at least one of said plurality of lines is attached to said force distributor;

a tensioning force that maintains constant tension in at least one of said plurality of lines when the plurality of lines is supporting the load, and a guide frame that is attached to the load by at least one of said plurality of lines.

43. The system of claim 42, wherein the force distributor comprises a spreader bar.

44. The active rigging system of claim 42, wherein said maintenance of constant tension reduces stress in the load.

45. The active rigging system of claim 42, wherein each of said plurality of lines are susceptible to slack, and said tensioning force system maintains tension on said line via enabling a resistance to said slack in at least one of said plurality of lines.

46. The active rigging system of claim 45, wherein the enabling of resistance to said slack is at least partially accomplished through an adjustment of a length of at least one of said plurality of lines.

* * * * *